US008176944B2

(12) United States Patent
Westerkamp

(10) Patent No.: US 8,176,944 B2
(45) Date of Patent: May 15, 2012

(54) PAPERMACHINE CLOTHING

(75) Inventor: Arved Westerkamp, Dettingen (DE)

(73) Assignee: Voith Fabrics Patent GmbH, Heidenheim (DE)

( * ) Notice: Subject to any disclaimer, the term of this patent is extended or adjusted under 35 U.S.C. 154(b) by 1239 days.

(21) Appl. No.: 11/185,701

(22) Filed: Jul. 21, 2005

(65) Prior Publication Data

US 2006/0016505 A1 Jan. 26, 2006

(30) Foreign Application Priority Data

Jul. 22, 2004 (DE) ..... 10 2004 035 519

(51) Int. Cl.
*D03D 3/04* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... 139/383 A, 139/383 AA
See application file for complete search history.

(56) References Cited

U.S. PATENT DOCUMENTS 4,815,499 A * 3/1989 Johnson ..... 139/383 A
4,998,568 A * 3/1991 Vohringer ..... 139/383 A
5,343,896 A * 9/1994 Schroder et al. ..... 139/383 A
5,465,764 A * 11/1995 Eschmann et al. ..... 139/383 A
5,544,678 A * 8/1996 Barrett ..... 139/383 A
5,613,527 A * 3/1997 Zimmermann et al. .. 139/383 A
5,826,627 A * 10/1998 Seabrook et al. ..... 139/383 A
6,123,116 A * 9/2000 Ward et al. ..... 139/383 A
6,202,705 B1 * 3/2001 Johnson et al. ..... 139/383 A
6,223,780 B1 * 5/2001 Kaldenhoff ..... 139/383 A
6,240,973 B1 * 6/2001 Stone et al. ..... 139/383 A
6,244,306 B1 * 6/2001 Troughton ..... 139/383 A
6,334,467 B1 * 1/2002 Barrett et al. ..... 139/383 A
6,354,335 B1 * 3/2002 Taipale et al. ..... 139/383 A
2004/0079434 A1 4/2004 Martin et al.

* cited by examiner

*Primary Examiner* — Bobby Muromoto, Jr.

(74) *Attorney, Agent, or Firm* — Greenblum & Bernstein, P.L.C.

(57) ABSTRACT

Paper machine clothing, such as a forming fabric formed by a large number of repeating units, wherein each repeat unit includes a paper-side woven structure having paper-side warp and weft threads and a machine-side woven structure having machine-side warp and weft threads, such that the paper side and the machine side woven structures are connected to each other by binding threads, and each repeat unit being formed by at least 26 warp threads and the paper machine clothing having a total thickness of 0.78 mm and less.

31 Claims, No Drawings

PAPERMACHINE CLOTHING

CROSS-REFERENCE TO RELATED APPLICATIONS

The present application claims priority under 35 U.S.C. §119 of German Patent Application No. 10 2004 035 519.3, filed on Jul. 22, 2004, the disclosure of which is expressly incorporated by reference herein in its entirety.

BACKGROUND OF THE INVENTION

1. Field of the Invention

The invention relates to a paper machine clothing forming a fabric formed by a large number of repeating units, wherein each repeat unit includes a paper-side woven structure having paper-side warp and weft threads and a machine-side woven structure having machine-side warp and weft threads, such that the paper side and the machine side woven structures are connected to each other by binding threads.

2. Discussion of Background Information

The invention relates to the production of graphic paper grades on high-speed paper machines, such that the paper speeds may be more than 1500 m/min, along with the width of the paper machine clothing more than 10 meters. A critical role in forming process of fabrics can be the thickness and woven structure used for paper-side and machine-side woven structure.

Depending on the specific application and/or customer-specific requirements for various production processes of graphic papers, there is an extremely wide range of requirements placed on forming fabric. For example, some of the forming fabric concerns may relate to the paper-side and machine-side side woven structure, the distribution of the supporting binding points and covering binding points of the binding threads connecting the paper-side and machine-side woven structures to each other. Other concerns in forming fabric may include the total thickness of the fabric.

Marking behavior and dewatering behavior characteristics of the fabric can be influenced by the configuration of the paper-side and the machine-side woven structure and by the distribution of the supporting binding points and covering binding points of the binding threads and by the total thickness of the clothing.

SUMMARY OF THE INVENTION

The paper machine clothing embodied according to the invention is characterized by a forming fabric, which is formed by a large number of repeating units (repeat units). Each repeat unit comprising a paper-side woven structure having paper-side warp and weft threads, a machine-side woven structure having machine-side warp and weft threads, and the paper-side and the machine-side woven structures being connected to each other by binding threads. In particular, each repeat unit is formed by at least 26 warp threads and the paper machine clothing has a total thickness of 0.78 mm and less.

The present invention improves paper machine clothing in forming a fabric, for example graphic paper grades on high-speed paper machines, and the like.

The invention provides a paper machine clothing, forming fabric having a plurality of repeat units forming the fabric. Wherein each repeat unit has a paper-side woven structure with at least one paper-side warp thread and at least one paper-side weft thread. Further, a machine-side woven structure may include at least one machine-side warp thread and at least one machine-side weft thread. Further still, at least one binding thread may be connected to a paper-side and a machine-side woven structure, such that each repeat unit may be formed by at least 26 warp threads. The paper machine clothing may have also have a total thickness of 0.78 mm and less.

According to another feature of the invention, the machine-side weft thread may have a diameter of 0.35 mm or less or 0.27 mm or less. Further, the fabric may have a total thickness of less than 0.72 mm, 0.65 or 0.55.

According to another feature of the invention, each repeat unit can be formed by at least 28, 30, 40 and 50 warp threads.

According to another feature of the invention, the machine-side woven structure may have a supporting binding point for each binding thread for every 13 to 20 machine-side warp threads/weft threads. Further, at least one set of at least two binding threads may follow one another and can be arranged without the machine-side threads or said paper-side threads extending in a cross machine direction lying between the at least one set of binding threads. Moreover, the at least one set binding threads may weave a weaving path of a single paper-side warp thread or a single paper-side weft thread. It is possible, the paper-side warp thread and said paper-side weft thread form a woven pattern, which is continued by weaving the at least one binding thread with at least one paper-side warp thread and at least one paper-side weft thread.

According to another feature of the invention, the distance between successive supporting binding points of mutually adjacent binding threads can be approximately between ¼ and ¾ of the distance between successive supporting binding points of said binding thread. Further, a ratio between at least one of the paper-side weft thread and at least one of the machine-side weft can be approximately 1 to 1, 2 to 1, 3 to 1, 3 to 2 or 4 to 3. Further still, a ratio between at least one of the paper-side warp thread and at least one of the machine-side warp can be approximately 1 to 1, 2 to 1, 3 to 1, 3 to 2 and 4 to 3

According to another feature of the invention, a distance between at least one paper-side warp ply and at least one machine-side warp ply in a region of one of a covering binding point and a supporting binding point can be at most 1.1 times a thickness of the binding thread under a tensile stress between 60 N/cm and 80 N/cm. Further, the distance between at least one paper-side warp ply and at least one machine-side warp ply in a region of the one of a covering binding point and a supporting binding point can be at most 1.05 times the thickness of the binding thread under tensile stress between 60 N/cm and 80 N/cm. Further still, the distance between at least one paper-side warp ply and at least one machine-side warp ply in a region of a covering binding point and a supporting binding point can be at most 1.02 times the thickness of the binding thread under tensile stress between 60 N/cm and 80 N/cm. It is possible for the at least one supporting binding points be irregularly distributed. Further, at least one of the supporting binding points could be distributed to avoid a concentration of supporting binding points. Further still, when the repeat unit of the supporting binding point of the binding thread includes a number N of the machine-side threads extending in the machine direction, a distance between two successive supporting binding points of the binding thread can be N−1 machine-side threads extending in the machine direction. It is possible for the distance between successive supporting binding points of a first and a second binding thread of a pair of binding threads to be in a range between approximately ¼(N−1) to ¾(N−1) machine-side threads extending in the machine direction.

Other exemplary embodiments and advantages of the present invention may be ascertained by reviewing the present disclosure.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention.

The paper machine clothing embodied according to the invention is characterized by a forming fabric, which is formed by a large number of repeating units (repeat units). Each repeat unit comprising a paper-side woven structure having paper-side warp and weft threads, a machine-side woven structure having machine-side warp and weft threads, and the paper-side and the machine-side woven structures being connected to each other by binding threads. In particular, each repeat unit is formed by at least 26 warp threads and the paper machine clothing has a total thickness of 0.78 mm and less.

Since the paper machine clothing has 26 or more warp threads per repeat unit, it is possible to combine paper-side and machine-side woven patterns with one another, so as to achieve particular requirements. For example, the paper-side woven pattern and the machine-side woven pattern of the paper machine clothing can be matched optimally and without compromise to achieve specific customer requirements for the production of graphic papers on high-speed machines. It is possible, the fabric can have a machine-side woven pattern matched to the high mechanical loadings of such machines, that can have a marking-free paper-side woven structure, without the possible variations that may be restricted by the limited number of warp threads per repeat unit.

In addition, the distribution of the arrangement of the supporting binding points and covering binding points, which influences the marking behavior, can be set optimally by using 26 or more warp threads per repeat unit. The covering binding points may be explained, as a binding thread that weaves over a paper-side warp or weft thread. A supporting binding point can be explained, as a binding thread that weaves under a machine-side warp or weft thread. Furthermore, between a covering binding point and a supporting binding point, the binding thread does not weave over any paper-side warp or weft thread or under any machine-side warp or weft thread. Since the binding threads are woven both with the paper-side warp or weft threads and with the machine-side warp or weft threads, the paper-side and the machine-side woven pattern and the drainage behavior during dewatering can be disrupted, for example, concerning the covering binding points and supporting binding points. In particular, if the covering binding points and supporting binding points in the repeat units are arranged to follow a regular pattern, e.g. hydraulic markings may become visible. As a result of using 26 and more warp threads per repeat unit, it is possible to distribute covering binding points and supporting binding points virtually freely, which may result in a reduced hydraulic marking in the clothing.

As a result of using clothing with a thickness of 0.78 mm or less, the volume of water carried along in the fabric may also be reduced. Moreover, in combination with the above proposed configuration of the woven pattern to distribute covering binding points and supporting binding points freely, may lead to a considerable reduction in causing hydraulic marking, as well as water entrainment.

Furthermore, the resulting effects of a paper machine clothing having a total thickness of 0.78 mm or less, may reduce the open volume occurring in high-speed machines, as well as reduce the disruption of the dewatering behavior, e.g. water entrainment which is known as spraying.

The paper machine clothing according to the invention has a total thickness of 0.78 mm or less, which provides adequate stability, abrasion resistance and transverse stiffness if the machine-side weft threads have a diameter of 0.35 mm or less.

In order to reduce the water entrainment and the hydraulic marking behavior, the paper machine clothing, a forming fabric have a total thickness of less than 0.72 mm, and/or particularly less than 0.65 mm, and/or quite particularly less than 0.55 mm.

The paper machine clothing according to the invention having a total thickness of 0.72 mm or less can provide adequate stability, abrasion resistance and transverse stiffness if the machine-side weft threads have a diameter of 0.27 mm or less.

According to the invention, the advantage of adapting the paper machine, so as to have the smallest repeat unit that is formed, e.g. by 28 or more or 30 or more or 40 or more or 50 or more warp threads, provides the ability to adapt the paper machine clothing to specific applications, as well as meeting customer-specific requirements.

According to the invention, trials have shown that the total thickness of the paper machine clothing can be influenced, and set exactly, if the machine-side woven structure has a supporting binding point for each binding thread for every 13 to 20 machine-side warp threads.

Moreover, the embodiment is based on the finding that two opposite effects are responsible for the thickness of woven paper machine clothing. For example:

In one particular case of two-ply fabrics, e.g. two warp layers and two weft layers with a binding thread system (no matter whether warp or weft direction), there is the problem that stiffness of the respective binding thread may have a negative effect on the layering of the plies, in relation to one another at each supporting binding point. In this case, lengthening the distance between the covering or supporting binding points on the various woven plies contributes to a reduction in the total thickness, as well as an increase in the stiffness.

The mechanism acting to reduce the total thickness can be the increase in the distance between the binding points of the binding threads, which permits lateral displacement of the threads. For this reason, it is desirable to separate the binding points of the binding threads as far from one another as possible and/or technically practical.

According to the invention, in this case, the distance between the plies additionally decreases, which as a consequence may lead to the bending stiffness becoming higher (the opposite ply tends to 'block' the bending).

In another particular case, according to the invention, too great a distance between supporting binding points can have the effect of the binding frequency between the paper-side and the machine-side woven structure that is not sufficient to achieve a desired low thickness of the fabric.

This can be understood if the woven paper machine clothing is provided with the machine-side woven structure having a supporting binding point for each binding thread for every 13 to 20 machine-side warp threads or weft threads. The resulting effect is a desired low thickness of the fabric compared with conventional fabrics.

It is possible for the binding threads to be woven either with the paper-side warp threads and with the machine-side warp threads, which can be understood as a weft-bound system. Further, for the binding threads to be woven with the paper-side weft threads and with the machine-side weft threads, it can be understood as a warp-bound system. Furthermore, it is possible for the warp threads to extend in the machine direction (MD), and for the weft threads to extend in the cross machine direction (CD) or vice versa.

According to the invention, the binding threads may be arranged to alternate at least in pairs in each case, such that two or three or more binding threads following one another are arranged without machine-side or paper-side CD threads lying between them. Further, in each case, some of the binding threads of a pair or triplet together weave the weaving path of a single paper-side warp or weft thread.

In order to reduce the tendency of marking according to the invention, the woven pattern formed by paper-side MD and CD threads can be continued by weaving the binding threads with the paper-side warp or weft threads, e.g. the binding threads are an integral constituent part of the paper-side woven structure.

According to the invention, as already discussed, the tendency to reduce marking can be achieved by the supporting binding points being distributed irregularly. Further, trials have shown the tendency to marking may further be reduced, if the supporting binding points are distributed, in such a way that no concentration of the supporting binding points is created. A particularly embodiment of the invention provides for the distance between successive supporting binding points of mutually adjacent binding threads of a pair of binding threads to be between ¼ and ¾ of the distance between successive supporting binding points of a binding thread. For example, this may be understood that in a repeat unit of the supporting binding points of a binding thread of 20 machine-side MD threads, the distance between two successive supporting binding points of a binding thread is 19 machine-side MD threads. Thus, the distance between successive supporting binding points of the first binding thread and of the second binding thread of a pair of binding threads is calculated to be values in the range between 19*¼=4.7, or approximately 5, and 19*¾=14.2, or approximately 14 for the machine-side MD threads.

According to the invention, the weft ratio between paper side and machine side may be 1:1 or 2:1 or 3:1 or 3:2 or 4:3.

According to the invention, the warp ratio between paper side and machine side may be 1:1 or 2:1 or 3:1 or 3:2 or 4:3.

Furthermore, trials have shown that the total thickness of the paper machine clothing may be reduced and the transverse stiffness of the fabric can be increased if the distance between the paper-side warp ply and machine-side warp ply in the region of a covering binding point/supporting binding point is at most 1.1 times the binding thread thickness, or at most 1.05 times the binding thread thickness, or particularly at most 1.02 times the binding thread thickness, under a tensile stress between 60 N/cm and 80 N/cm.

The invention is not restricted to the embodiment described. Thus, for example, the paper machine clothing can be a forming fabric.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A paper machine clothing, forming fabric, comprising:
a plurality of repeat units forming the fabric;
each said repeat unit comprising:
a paper-side woven structure having at least one paper-side warp thread and at least one paper-side weft thread;
a machine-side woven structure having at least one machine-side warp thread and at least one machine-side weft thread;
at least one binding thread connecting said paper-side and said machine-side woven structures to each other,
wherein each said repeat unit is formed by at least 26 warp threads and the paper machine clothing has a total thickness of 0.78 mm and less.

2. The paper machine clothing device according to claim 1, wherein said at least one machine-side weft thread has a diameter of 0.35 mm or less.

3. The paper machine clothing device according to claim 1, wherein the fabric has a total thickness of less than 0.72 mm.

4. The paper machine clothing device according to claim 1, wherein the fabric has a total thickness of less than 0.65 mm.

5. The paper machine clothing device according to claim 1, wherein the fabric has a total thickness of less than 0.55 mm.

6. The paper machine clothing device according to claim 1, wherein said at least one machine-side weft thread has a diameter of 0.27 mm or less.

7. The paper machine clothing device according to claim 1, wherein each said repeat unit is formed by at least 28 warp threads.

8. The paper machine clothing device according to claim 1, wherein each said repeat unit is formed by at least 30 warp threads.

9. The paper machine clothing device according to claim 1, wherein each said repeat unit is formed by at least 40 warp threads.

10. The paper machine clothing device according to claim 1,
wherein each said repeat unit is formed by at least 50 warp threads.

11. The paper machine clothing device according to claim 1,
wherein said machine-side woven structure has a supporting binding point for each said binding thread for every 13 to 20 machine-side warp threads/weft threads.

12. The paper machine clothing device according to claim 1,
wherein at least one set of at least two binding threads follow one another and are arranged without said machine-side threads or said paper-side threads extending in a cross machine direction lying between said at least one set of at least two binding threads, such that said at least one set of at least two binding threads weave a weaving path of a single paper-side warp thread or a single paper-side weft thread.

13. The paper machine clothing device according to claim 1, wherein said paper-side warp thread and said paper-side weft thread form a woven pattern, which is continued by weaving said at least one binding thread with at least one paper-side warp thread and at least one paper-side weft thread.

14. The paper machine clothing device according to claim 11, wherein the distance between successive supporting binding points of mutually adjacent binding threads is approximately between ¼ and ¾ of the distance between successive supporting binding points of said binding thread.

15. The paper machine clothing device according to claim 1, wherein a ratio between at least one of said paper-side weft thread and at least one of said machine-side weft is approximately 1 to 1.

16. The paper machine clothing device according to claim 1, wherein a ratio between at least one of said paper-side well thread and at least one of said machine-side well is approximately 2 to 1.

17. The paper machine clothing device according to claim 1, wherein a ratio between at least one of said paper-side well thread and at least one of said machine-side weft is approximately 3 to 1.

18. The paper machine clothing device according to claim 1, wherein a ratio between at least one of said paper-side well thread and at least one of said machine-side weft is approximately 3 to 2.

19. The paper machine clothing device according to claim 1, wherein a ratio between at least one of said paper-side well thread and at least one of said machine-side weft is approximately 4 to 3.

20. The paper machine clothing device according to claim 1, wherein a ratio between at least one of said paper-side warp thread and at least one of said machine-side warp is approximately 1 to 1.

21. The paper machine clothing device according to claim 1, wherein a ratio between at least one of said paper-side warp thread and at least one of said machine-side warp is approximately 2 to 1.

22. The paper machine clothing device according to claim 1, wherein a ratio between at least one of said paper-side warp thread and at least one of said machine-side warp is approximately 3 to 1.

23. The paper machine clothing device according to claim 1, wherein a ratio between at least one of said paper-side warp thread and at least one of said machine-side warp is approximately 3 to 2.

24. The paper machine clothing device according to claim 1, wherein a ratio between at least one of said paper-side warp thread and at least one of said machine-side warp is approximately 4 to 3.

25. The paper machine clothing device according to claim 1, wherein a distance between at least one paper-side warp ply and at least one machine-side warp ply in a region of one of a covering binding point and a supporting binding point is at most 1.1 times a thickness of said binding thread under a tensile stress between 60 N/cm and 80 N/cm.

26. The paper machine clothing device according to claim 25, wherein the distance between said at least one paper-side warp ply and said at least one machine-side warp ply in a region of said one of a covering binding point and a supporting binding point is at most 1.05 times said thickness of said binding thread under tensile stress between 60 N/cm and 80 N/cm.

27. The paper machine clothing device according to claim 25, wherein the distance between said at least one paper-side warp ply and said at least one machine-side warp ply in a region said one of a covering binding point and a supporting binding point is at most 1.02 times said thickness of said binding thread under tensile stress between 60 N/cm and 80 N/cm.

28. The paper machine clothing device according to claim 11, wherein at least one of said supporting binding points are irregularly distributed.

29. The paper machine clothing device according to claim 11, wherein at least one of said supporting binding points are distributed to avoid a concentration of supporting binding points.

30. The paper machine clothing device according to claim 11, wherein when said repeat unit of said supporting binding point of said binding thread comprises a number N of said machine-side threads extending in the machine direction, a distance between two successive supporting binding points of said binding thread is N−1 machine-side threads extending in the machine direction.

31. The paper machine clothing device according to claim 30, wherein the distance between successive supporting binding points of a first and a second binding thread of a pair of binding threads is in a range between approximately ¼(N−1) to ¾(N−1) machine-side threads extending in the machine direction.

* * * * *